US006985553B2

(12) United States Patent
Leung et al.

(10) Patent No.: US 6,985,553 B2
(45) Date of Patent: Jan. 10, 2006

(54) ULTRA-SHORT ION AND NEUTRON PULSE PRODUCTION

(75) Inventors: Ka-Ngo Leung, Hercules, CA (US); William A. Barletta, Oakland, CA (US); Joe W. Kwan, Castro Valley, CA (US)

(73) Assignee: The Regents of the University of California, Oakland, CA (US)

( * ) Notice: Subject to any disclaimer, the term of this patent is extended or adjusted under 35 U.S.C. 154(b) by 0 days.

(21) Appl. No.: 10/350,573

(22) Filed: Jan. 23, 2003

(65) Prior Publication Data

US 2004/0146133 A1 Jul. 29, 2004

Related U.S. Application Data

(60) Provisional application No. 60/350,071, filed on Jan. 23, 2002.

(51) Int. Cl.
*G21G 1/06* (2006.01)

(52) U.S. Cl. ..... 376/158; 361/230

(58) Field of Classification Search ..... 376/108, 376/111–116, 119, 144, 145, 158, 159; 250/213, 250/396, 427, 423 R; 315/39, 111.21, 111.81; 313/359.1, 396; 361/230; 204/415
See application file for complete search history.

(56) References Cited

U.S. PATENT DOCUMENTS 3,258,402 A * 6/1966 Farnsworth ..... 376/107
3,281,617 A * 10/1966 Wood ..... 376/116
3,581,093 A * 5/1971 Carr ..... 376/116
3,609,369 A * 9/1971 Croitoru ..... 376/108
3,719,827 A * 3/1973 Dennis ..... 376/119
4,076,990 A * 2/1978 Hendry et al. ..... 376/151
4,210,813 A * 7/1980 Romanovsky et al. ..... 378/101
4,447,732 A 5/1984 Leung et al.
4,529,571 A * 7/1985 Bacon et al. ..... 376/144
4,793,961 A * 12/1988 Ehlers et al. ..... 376/127
4,904,872 A * 2/1990 Grix et al. ..... 250/423 R
5,198,677 A 3/1993 Leung et al.
5,293,410 A * 3/1994 Chen et al. ..... 376/108
5,517,084 A * 5/1996 Leung ..... 315/111.81
5,745,536 A * 4/1998 Brainard et al. ..... 376/114
5,945,677 A * 8/1999 Leung et al. ..... 250/396 R
6,094,012 A * 7/2000 Leung et al. ..... 315/111.81
6,141,395 A * 10/2000 Nishimura et al. ..... 376/114
6,376,978 B1 * 4/2002 Leung et al. ..... 313/359.1

(Continued)

OTHER PUBLICATIONS

Szabo, "Pulsed neutron source for reactor physics", Nuclear Instruments and Methods, 78 (1970), pp 199-205.*

(Continued)

*Primary Examiner*—Jack Keith
*Assistant Examiner*—Daniel Lawson Greene, Jr.
(74) *Attorney, Agent, or Firm*—Joseph R. Milner

(57) ABSTRACT

An ion source has an extraction system configured to produce ultra-short ion pulses, i.e. pulses with pulse width of about 1 $\mu$s or less, and a neutron source based on the ion source produces correspondingly ultra-short neutron pulses. To form a neutron source, a neutron generating target is positioned to receive an accelerated extracted ion beam from the ion source. To produce the ultra-short ion or neutron pulses, the apertures in the extraction system of the ion source are suitably sized to prevent ion leakage, the electrodes are suitably spaced, and the extraction voltage is controlled. The ion beam current leaving the source is regulated by applying ultra-short voltage pulses of a suitable voltage on the extraction electrode.

15 Claims, 5 Drawing Sheets

U.S. PATENT DOCUMENTS

| | | | | |
|---|---|---|---|---|
| 6,486,480 | B1 * | 11/2002 | Leung et al. | 250/492.21 |
| 2002/0131542 | A1 * | 9/2002 | Leung | 376/108 |
| 2002/0131543 | A1 * | 9/2002 | Leung | 376/108 |
| 2002/0150193 | A1 * | 10/2002 | Leung et al. | 376/108 |

OTHER PUBLICATIONS

Szabo, Pulsed neutron source for reactor physics, Nuclear Instruments & Methods, 78 (1970), pp 199-205.*

Lomer, P.D.;Bounden, J.E.; Wood, J.D.L.H., "High Output Neutron Generating Tubes," CONF-650405-2, Services Electronics Rsrch Lab (Baldock, England), p. 623-34, (Sep. 1, 1964).

Eyrich, W.; Schmidt, A., "Two Compact, High-Intensity Pulsed Neutron Sources," Technical Report No. KFK-304; SM-62/4; SM-62/4, Federal Republic of Germany (Germany), p. 589-608, (May 1, 1965).

Lomer, P.D.;Bounden, J.E.; Wood, J.D.L.H., "A Neutron Tube with Constant Output," Nucl. Instr. Methods, Services Electronics Resrch Lab (Baldock, England), p. 283-288, (Mar. 1, 1965).

Perkins, et al. "A Compact, RF-Driven, Pulsed ION Source For Intense Neutron Generation," IEEE, 1998, pp. 2761-2763.

Reijonen, et al. "Compact Neutron Source Development At LBNL, eScholarship Repository," 2001 (8 pages).

* cited by examiner

ULTRA-SHORT ION AND NEUTRON PULSE PRODUCTION

RELATED APPLICATIONS

This application claims priority of Provisional Application Ser. No. 60/350,071 filed Jan. 23, 2002, which is herein incorporated by reference.

GOVERNMENT RIGHTS

The United States Government has rights in this invention pursuant to Contract No. DE-AC03-76SF00098 between the United States Department of Energy and the University of California.

BACKGROUND OF THE INVENTION

The invention relates to plasma ion generators and neutron sources based on plasma ion generators, and more particularly to the production of ultra-short pulses from these ion generators and neutron sources.

In many applications, such as time of flight measurements, ultra-short neutron pulses (pulse width<1 $\mu$s) with fast rise times or fall times are desired. These neutrons can be high energy, epithermal, thermal, or cold neutrons, and they are normally produced by a fission reactor or an accelerator-based neutron generator. When ultra-short pulses are needed, the neutron output flux can be chopped by means of a rotating mechanical chopper.

There are some disadvantages when these mechanical chopper schemes are used to form ultra-short neutron pulses. First, a large percentage of neutrons will be discarded and activation of material may occur. Second, when pulsed accelerator systems are employed, the mechanical chopper and the ion beam acceleration have to be properly synchronized. Ultra-short pulses cannot be formed by manipulating the plasma discharge because the rise time due to plasma buildup is typically on the order of a few $\mu$s.

Other neutron sources are based on ion generators. Conventional neutron tubes employ a Penning ion source and a single gap extractor. The target is a deuterium or tritium chemical embedded in a molybdenum or tungsten substrate.

University of California, Lawrence Berkeley National Laboratory has produced a number of compact neutron sources with a relatively high flux, particularly sources which generate neutrons using the D—D reaction instead of the D–T reaction. These sources have a variety of different geometries, including tubular, cylindrical, and spherical, and are based on plasma ion sources, particularly multicusp plasma ion sources, with single or preferably multiple beamlet extraction. These neutron sources are illustrated by copending U.S. patent applications Ser. Nos. 10/100,956; 10/100,962; and 10/100,955.

SUMMARY OF THE INVENTION

The invention is an ion source with an extraction system configured to produce ultra-short ion pulses, i.e. pulses with pulse width of about 1 $\mu$s or less and fast rise times or fall times or both, and a neutron generator based on the ion source which produces correspondingly ultra-short neutron pulses. A deuterium ion (or mixed deuterium and tritium ion or even a tritium ion) plasma is produced by RF excitation in a plasma ion generator using an RF antenna. The ion generator is preferably a multicusp plasma ion source. The single or multi-aperture extraction system of the ion source has two spaced electrodes—a plasma electrode and an extraction electrode. Although a single aperture extraction system can be used, a multi-aperture extraction system is preferred for higher ion extraction current and neutron flux. The plasma and extraction electrodes of a multiple beamlet system are typically spherical or cylindrical in shape.

To form a neutron generator, a neutron generating target is positioned to receive the extracted ion beam from the ion generator. The extracted ions are accelerated to energies in excess of 100 keV before impinging on the target, which becomes loaded with neutral deuterium and/or tritium atoms. Very short pulses of 2.45 MeV D—D neutrons or 14.1 MeV D-T neutrons will be produced by striking the target with ultra-short ion beam bursts.

To produce the ultra-short ion or neutron pulses, the apertures in the extraction system are suitably sized to prevent ion leakage, the electrodes are suitably spaced, and the extraction voltage is controlled. The ion beam current leaving the source is regulated by applying short voltage pulses of a suitable voltage on the extraction electrode.

DETAILED DESCRIPTION OF THE INVENTION

A. Ion Source, Neutron Source

Figure 1:
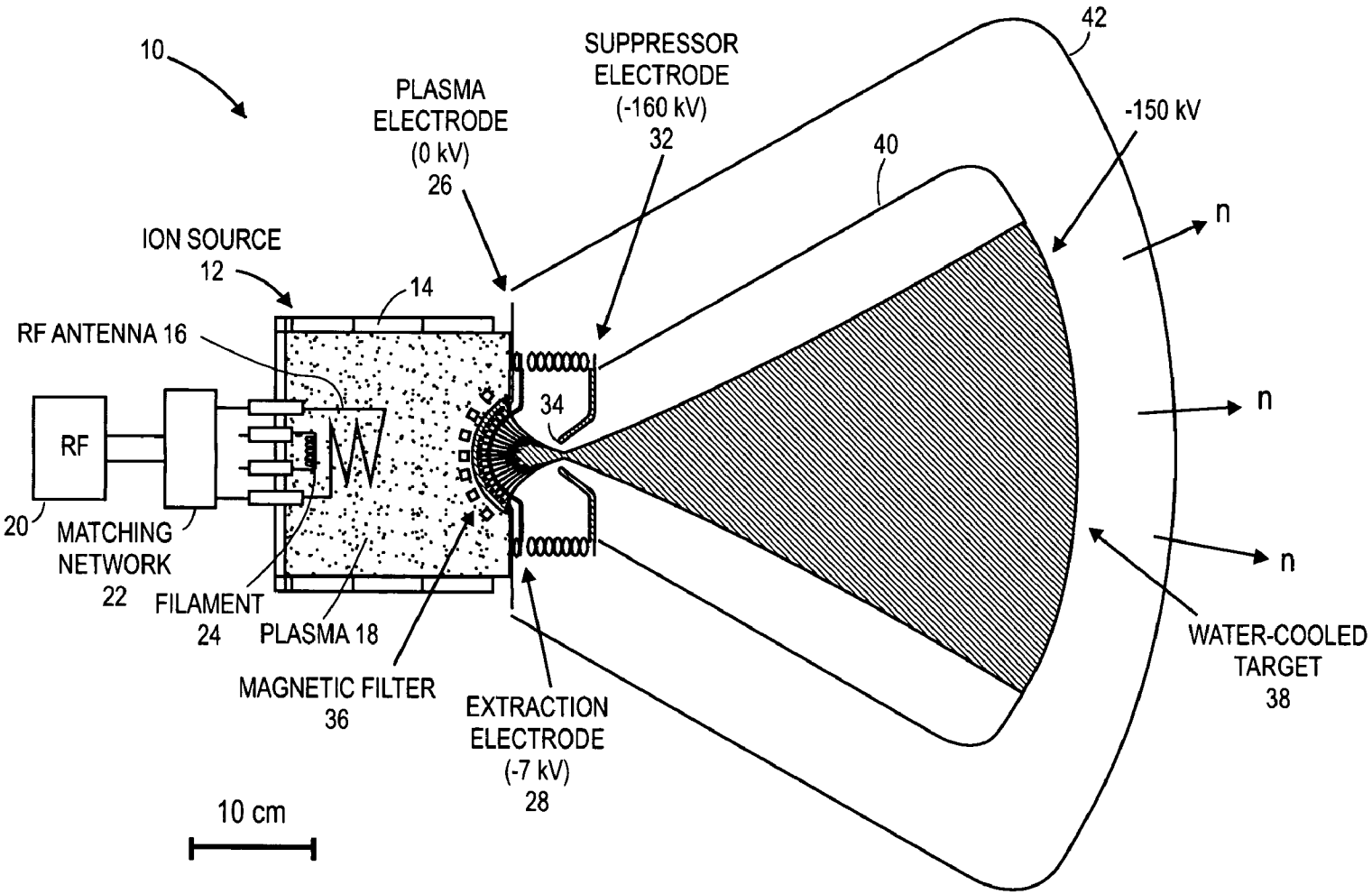
FIG. 1 is a cross sectional view of an ion source and neutron generator which can be used to produce ultra-short pulses according to the invention.

As shown in FIG. 1, compact high flux neutron generator 10 has a plasma ion source or generator 12, which typically is formed of a cylindrical shaped chamber. The principles of plasma ion sources are well known in the art. Preferably, ion source 12 is a magnetic cusp plasma ion source. Permanent magnets 14 are arranged in a spaced apart relationship, running longitudinally along plasma ion generator 12, to form a magnetic cusp plasma ion source. The principles of magnetic cusp plasma ion sources are well known in the art. Conventional multicusp ion sources are illustrated by U.S. Pat. Nos. 4,793,961; 4,447,732; 5,198,677; 6,094,012, which are herein incorporated by reference.

Ion source 12 includes an RF antenna (induction coil) 16 for producing an ion plasma 18 from a gas which is introduced into ion source 12. RF antenna 16 is connected to RF power supply 20 through matching network 22. Ion source 12 may also include a filament 24 for startup. For neutron generation the plasma is preferably a deuterium ion plasma but may also be a deuterium and tritium plasma (or even a tritium plasma).

Ion source 12 also includes a pair of spaced electrodes, plasma electrode 26 and extraction electrode 28, at one end thereof. Electrodes 26, 28 electrostatically control the passage of ions from plasma 18 out of ion source 12. Electrodes 26, 28 are substantially spherical or curved in shape (e.g. they are a portion of a sphere, e.g. a hemisphere) and contain many aligned holes 30 (shown in FIG. 2) over their surfaces so that ions radiate out of ion source 12. (In the simplest embodiment, there would only be a single extraction hole 30 in electrodes 26, 28.) Suitable extraction voltages are applied to electrodes 26, 28, e.g. plasma electrode 26 is at 0 kV and extraction electrode 28 is at −7 kV, so that positive ions are extracted from ion source 12.

Figure 2:
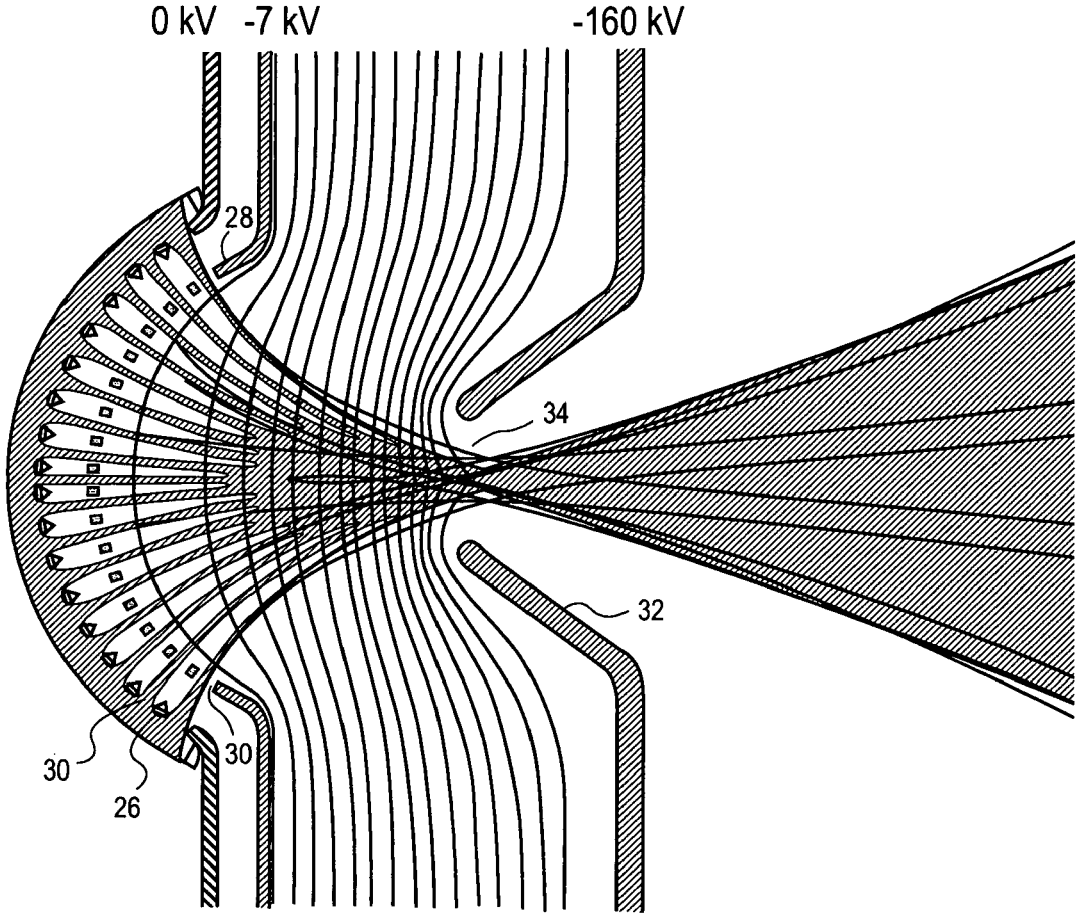
FIGS. 2, 3 are more detailed views of the extraction/acceleration system of the ion source.
Figure 3:
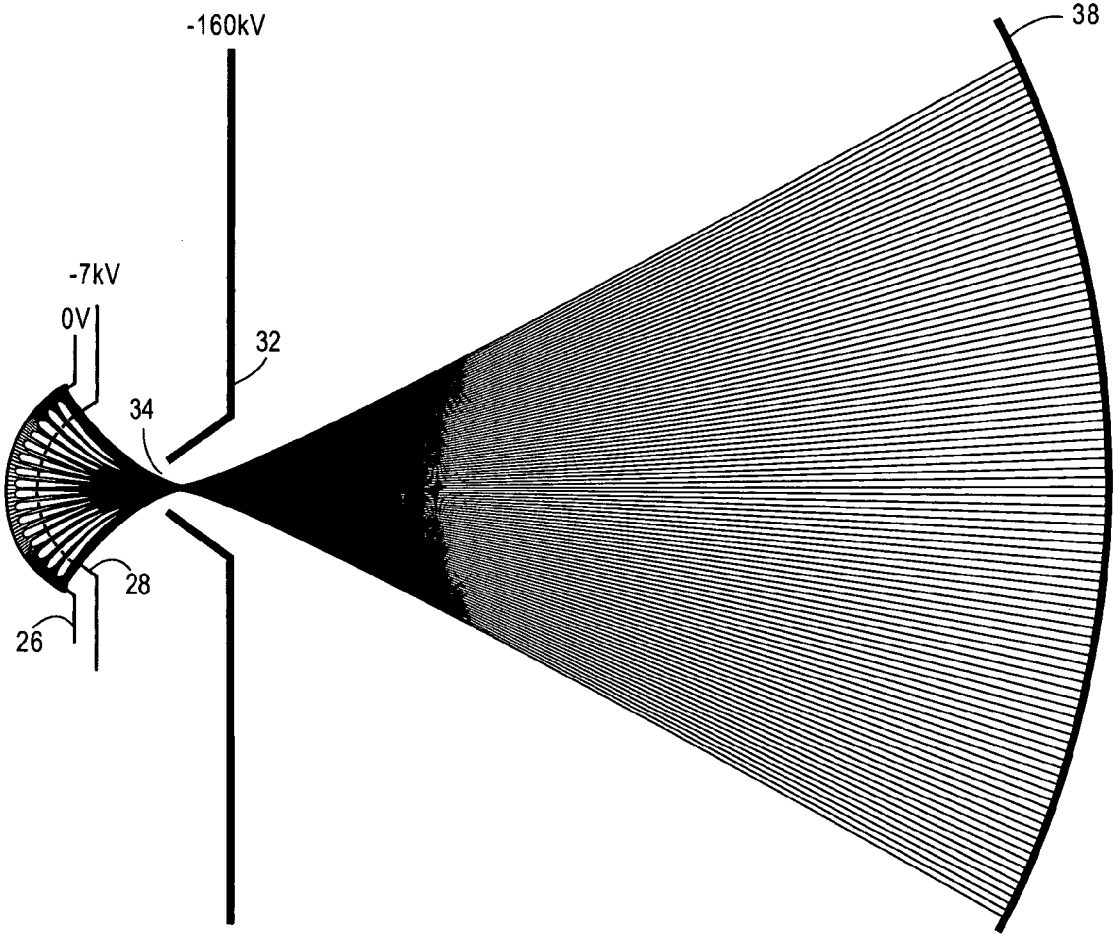

The extraction system of ion source 12 includes a third electrode, suppressor electrode 32 which contains a central aperture 34 therein. Suppressor electrode 32 is at a relatively high negative voltage, e.g. −160 kV, to accelerate the extracted ion beam. The three electrode extraction/accelerator system is used to expand a high current ion beam in a relatively short distance. The spherical shapes of the plasma and extraction electrodes 26, 28 are such that the ion beams (or beamlets) passing through all the holes 30 in electrodes 26, 28 are focused close to the suppressor electrode 32, pass through aperture 34, cross over, and expand or diverge on the other side of suppressor electrode 32. The diverging beam expands to a large area in a relatively short distance. Details of the extraction and acceleration system are shown in FIGS. 2, 3.

The plasma density on the ion source side of the plasma electrode 26 must be uniform over the entire extraction area to ensure good ion beam extraction. Plasma uniformity is obtained by positioning a spherically curved magnetic filter 36 inside ion source 12 in front of plasma electrode 26.

A spherically curved target 38 is positioned so that the expanding ion beam from ion source 12 passing through electrodes 26, 28, 32 is incident thereon. Target 38 forms a portion of a spherical surface of relatively large area at a relatively short distance from ion source 12. Target 38 is the neutron generating element, and may be water cooled. Target 38 is at a positive voltage relative to the suppressor electrode 32, e.g. at −150 kV.

Ions from plasma source 12 pass through holes 30 in electrodes 26, 28, and through aperture 34 in electrode 32, and impinge on target 38, typically with energy of 120 keV to 150 keV, producing neutrons as the result of ion induced reactions. The target 38 is loaded with D (or D/T) atoms by the beam. Titanium is not required, but is preferred for target 38 since it improves the absorption of these atoms. Target 38 may be a titanium shell or a titanium coating on another chamber wall 40, e.g. a quartz tube.

Ion source 12 is positioned at one end of a sealed tube 42, which also contains suppressor electrode 32, and neutron generating target 38, to form neutron generator 10. The entire neutron generator is very compact, e.g. about 30 cm in length.

Because of the relatively large target area of target 38, and the high ion current from ion source 12, neutron flux can be generated from D—D reactions in this neutron generator as well as from D–T reactions as in a conventional neutron tube, eliminating the need for radioactive tritium. The neutrons produced, 2.45 MeV for D—D or 14.1 MeV for D–T, will go out from the end of tube 42.

The neutron generator of the invention has a unique combination of high neutron production and compact size. The small size of the neutron generator is due mainly to the configuration of the extraction system, which allows one to extract a large ion beam current from a small ion source and to expand it onto a large area target. The large ion beam current is necessary for the high neutron output, because the neutron output is directly proportional to the ion beam current striking the target. The large area ion beam at the target is required to decrease the ion beam power density on the target, which would otherwise overheat the target and reduce neutron production. Compactness and high neutron output are achieved with the innovative extraction system and magnetic filter design.

While the invention has been described with respect to a spherical electrode geometry, an alternate embodiment can be implemented with a cylindrical geometry, i.e. electrodes 26, 28 are cylindrical in shape (i.e. portions of cylinders), with aligned slots 30; suppressor electrode 32 is cylindrical, with central slot 34; and target 38 is cylindrical. The ion beam then focuses down to a line and expands to impinge on the target.

The neutron generator of FIG. 1 has a tubular configuration, as shown in U.S. application Ser. No. 10/100,956. Other neutron generator configurations include cylindrical, as shown in Ser. No. 10/100,962, and spherical, as shown in Ser. No. 10/100,955. All these applications are herein incorporated by reference. The principles of the invention for ultra-short pulse production apply to any configuration.

B. Ultra-short Pulse Production

Ultra-short pulses of ions or neutrons, having pulse widths of about 1 $\mu$s or less with fast rise times or fall times or both, are produced by the design of the extraction system of the ion source and by controlling the extraction voltage. The ion beam current extracted from the ion source has an ultra-short pulse width by applying corresponding ultra-short voltage pulses on the extraction electrode. The pulse width is also controlled by designing the aperture(s) in the extraction system with a diameter that is not much greater than the plasma sheath thickness in the ion source, and by spacing the electrodes of the extraction system a distance about equal to the aperture diameter. To produce ultra-short neutron pulses, a neutron generating target is struck by accelerated ultra-short ion beam bursts of suitable ions, such as D, T, or D and T.

In a typical ion source beam extraction system, the plasma potential is usually at a few volts above the plasma chamber potential (local ground) and the plasma electrode (the first or beam-forming electrode) is on the order of 10 volts below the local ground potential. The potential drop from the plasma potential to the plasma electrode potential occurs within a sheath region that has a thickness of about $10\lambda_D$. The Debye shielding length $\lambda_D$ is given by $$\lambda_D = \sqrt{\frac{kT}{4\pi ne^2}}$$

where T is the electron temperature and n is the plasma density. For a typical plasma with electron temperature T up to 10 eV and plasma density n at about $5\times10^{11}$ cm$^3$, $10\lambda_D$ is about 30 $\mu$m.

Ions are accelerated from the plasma into the sheath while electrons are rejected by the sheath. However, if an aperture, on the plasma electrode is much larger than the sheath thickness, the sheath will "wrap around" the aperture, allowing the plasma to flow through the aperture without rejecting the electrons, i.e. the plasma simply leaks out of the aperture, preventing sharp narrow pulses from being formed.

Figure 4A:
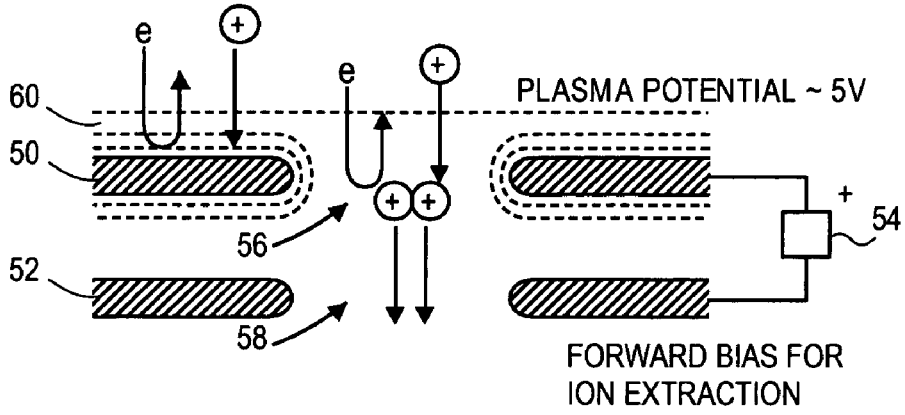
FIGS. 4A–C illustrate the effects of aperture size on ion extraction.

This situation is shown in FIG. 4A. The extraction system has a plasma electrode 50 and a spaced extraction electrode 52. A bias supply 54 is connected between electrodes 50, 52. A forward bias (electrode 52 is negative with respect to electrode 50) is applied for (positive) ion extraction and a reverse bias (electrode 52 is positive with respect to electrode 50) is applied to stop positive ions and for electron (and negative ion) extraction. Electrodes 50, 52 include one (or more) aligned apertures 56, 58 respectively.

Figure 4B:
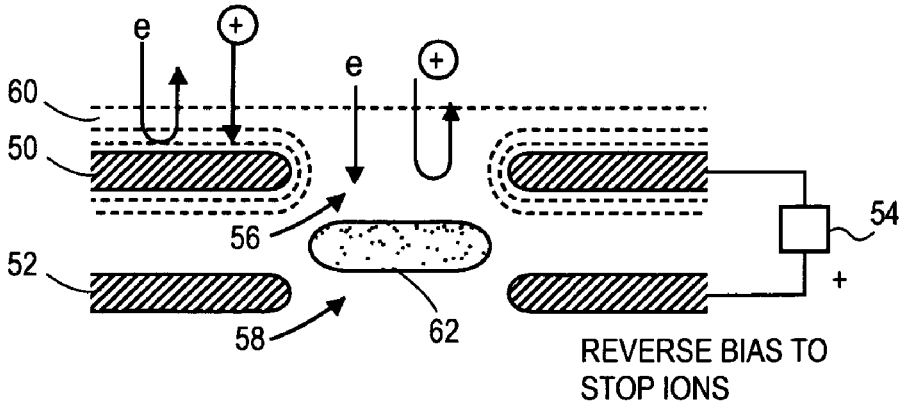

Plasma sheath 60 is adjacent to plasma electrode 50 and has a thickness t of about 30 μm. When the diameter d of aperture 56 in plasma electrode 50 is much greater than the plasma sheath thickness, i.e. d>>t, plasma leaks through aperture 56 around electrode 50. When a forward biased voltage is applied to extraction electrode 52, ions are accelerated and electrons are repelled, as shown in FIG. 4A. When a reverse biased voltage is applied to electrode 52, ions are repelled and electrons are accelerated, as shown in FIG. 4B. An electrode cloud 62 can build up between electrodes 50, 52 which can short out the electrodes.

Figure 4C:
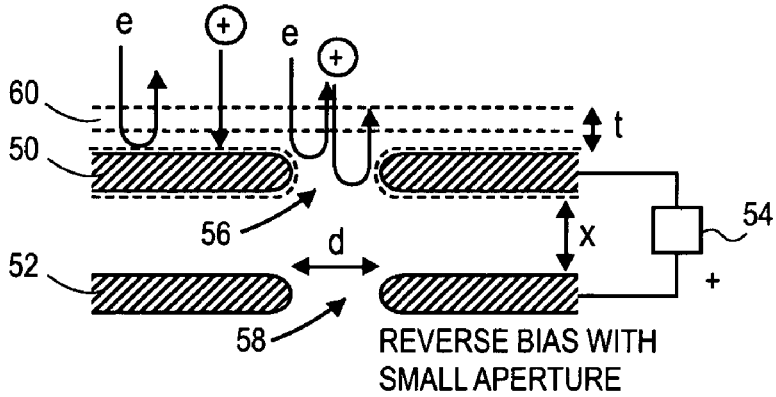

If the diameter of aperture 56 (and 58) is made smaller than the sheath thickness t, then the sheath 60 can cover the aperture, even in the reverse biased condition, as shown in FIG. 4C. Thus for micron sized apertures, most electrons cannot escape, even for a reverse bias voltage. Therefore, because of the ability to control ion extraction, micron sized apertures are preferred in the extractor system electrodes for producing ultra-short pulse widths. A multiple aperture multiple beamlet extraction system is thus preferred for the ion sources.

To control the ion flow to produce good beam optics, the distance x between the plasma electrode 50 and the extraction electrode 52 must have approximately the same dimension as the aperture diameter d, i.e. an aspect ratio x/d of about 1. The potential required to repel ions at the extraction electrode is slightly above the plasma potential. Thus the voltage difference between the electrodes is about 20 V. The minimum required voltage gradient is 0.6 MV/m. In the forward bias case, the extraction electrode can be biased at local ground potential or some negative potential depending on the current density and beam optics design.

Figure 5:
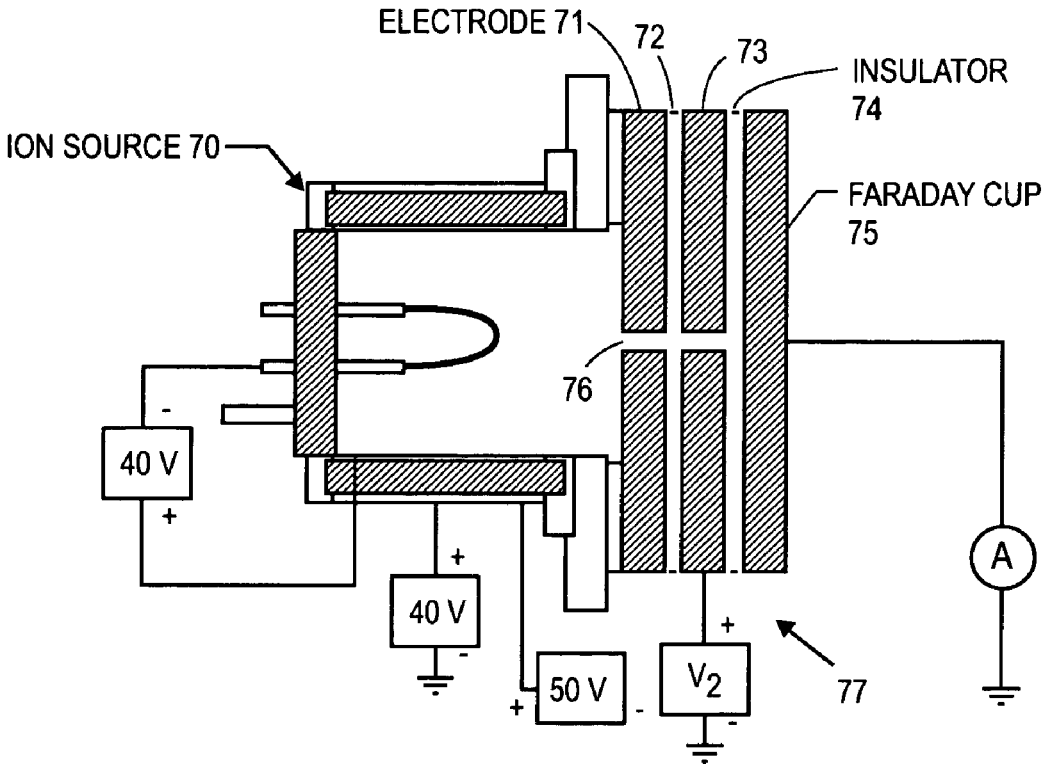
FIG. 5 is a cross sectional view of a simple single hole beam switching system.

This biasing effect has been experimentally demonstrated, using a single aperture setup as shown in FIG. 5. Experiments showed that ion as well as electron beams can be switched on and off using a biasing electrode 73 that stops the charged particles from exiting ion source 70. Biasing electrode 73 is part of a switchable extraction aperture system 77 that has two conducting electrodes 71, 73 separated by insulator layer 72. Electrode 71 is the plasma electrode and electrode 73 is the extraction electrode. System 77 is followed by insulator layer 74 and faraday cup 75. An aperture 76 is formed in the electrode and insulator layers.

Electrode 71 is biased negatively (about 30 V) with respect to the chamber wall. Electrode 73 is used to stop the flow of ions by applying a positive bias with respect to the ion source chamber. Using argon as the working gas, a plasma discharge was produced with a discharge power of 40 W. The gas pressure inside the source was 2 mTorr. The source is biased at 30 V to allow the ions to be extracted, and the current is measured with the Faraday cup at ground potential. Electrode 71 is also biased with respect to the source to prevent back streaming electrons when the beam is switched on, and to avoid electron extraction when the beam is switched off. The beam energy at the Faraday cup is equal to the source potential plus the plasma potential. Because the discharge power is so low, the plasma potential is almost negligible. Thus, to read ion beam current at the Faraday cup, electrode 73 has to be biased equal to or less than the source. Experimentally, electrode 73 is first set at ground potential, which allows the ions to be extracted. The Faraday cup reads 23 nA. When electrode 73 is biased at 31 V, i.e. 1 V more positive than the source potential, the Faraday cup reading drops down to zero.

Thus, by providing a micro-channel biasing system with a fast voltage switch, the invention enables one to generate ion and neutron beams with very short duration, about 1 μs or less and fast rise time and/or fall time. These ultra-short ion and neutron pulses can be used for a variety of applications, including neutron interrogation of nuclear materials and induction linacs.

Changes and modifications in the specifically described embodiments can be carried out without departing from the scope of the invention which is intended to be limited only by the scope of the appended claims.

What is claimed is:

1. An ion source for generating ultra-short pulses of ions, comprising:

a plasma ion generator;

an ion extraction system including both a plasma electrode and an extraction electrode;

said plasma electrode disposed adjacent plasma produced by said plasma ion generator;

said extraction electrode disposed apart from said plasma electrode;

each of said plasma electrode and said extraction electrode including at least one aperture there through, said plasma electrode and said extraction electrode aligned with respect to each other so that the apertures are aligned to permit ions to pass out from said plasma ion generator and through the apertures;

each aperture having diameters that are greater than a plasma sheath region thickness that is adjacent said plasma electrode, and the diameters being less than permits the plasma sheath region to wrap around the aperture through said plasma electrode to pass both ions and electrons through the aperture when a reverse voltage bias is connected to said extraction electrode to prevent ions from passing through the aperture in said extraction electrode; and, a pulse bias voltage supply connected to said extraction electrode to apply a forward bias voltage pulse having voltage pulse width, polarity and magnitude so a pulse of ions passes through the aperture in said extraction electrode that has a pulse width comparable to the voltage pulse width.

2. The ion source of claim 1 wherein the plasma ion generator is a multicusp plasma ion generator.

3. The ion source of claim 1 wherein the plasma ion generator is a RF driven plasma ion generator.

4. The ion source of claim 3 further comprising:

a RF antenna disposed within the plasma ion generator;

a matching network connected to the RF antenna; and a RF power supply connected to the matching network.

5. The ion source of claim 1 wherein the extraction system is a multi-aperture extraction system.

6. The ion source of claim 1 wherein the plasma ion generator is a deuterium ion generator or a deuterium and tritium ion generator.

7. The ion source of claim 1 wherein the electrode spacing is about equal to the aperture diameter.

8. A neutron source for generating ultra-short pulses of neutrons, comprising;

an ion source of claim 1 for generating ultra-short pulses of ions;

a neutron generating target spaced apart from the ion source so that ions extracted from the ion source impinge on the target;

an acceleration system between the ion source and target for accelerating the ions to a suitable energy.

9. The neutron source of claim 8 wherein the plasma ion generator is a multicusp plasma ion generator.

10. The neutron source of claim 8 wherein the plasma ion generator is a RF driven plasma ion generator.

11. The neutron source of claim 10 further comprising:

a RF antenna disposed within the plasma ion generator;

a matching network connected to the RF antenna; and a RF power supply connected to the matching network.

12. The neutron source of claim 8 wherein the extraction system is a multi-aperture extraction system.

13. The neutron source of claim 8 wherein the plasma ion generator is a deuterium ion generator or a deuterium and tritium ion generator.

14. The neutron source of claim 8 wherein the electrode spacing is about equal to the aperture diameter.

15. The neutron source of claim 8 wherein the acceleration system is a system for accelerating the ions to at least about 100 keV.

* * * * *